US008485857B1

(12) United States Patent
DeSalvo

(10) Patent No.: US 8,485,857 B1
(45) Date of Patent: Jul. 16, 2013

(54) METHOD OF PRODUCING A SPARK GAP FOR AN ELECTRODE SUPPORT USING SACRIFICIAL MATERIAL

(75) Inventor: Peter John DeSalvo, Jacksonville, FL (US)

(73) Assignee: General Electric Company, Schenectady, NY (US)

( * ) Notice: Subject to any disclaimer, the term of this patent is extended or adjusted under 35 U.S.C. 154(b) by 68 days.

(21) Appl. No.: 13/357,307

(22) Filed: Jan. 24, 2012

(51) Int. Cl.
*H01T 21/02* (2006.01)

(52) U.S. Cl.
USPC ..... 445/7; 313/141

(58) Field of Classification Search
USPC ..... 313/118–145; 445/7; 123/32, 41, 123/143 R, 146.5 R, 169 P, 260, 280, 169 R, 123/169 EL, 310; 219/121.6, 121.64
See application file for complete search history.

(56) References Cited

U.S. PATENT DOCUMENTS

| | | | |
|---|---|---|---|
| 3,586,903 | A | 6/1971 | Taterzynski et al. |
| 5,502,294 | A | 3/1996 | Yang |
| 6,676,468 | B2 | 1/2004 | Ishiguro et al. |
| 2002/0055318 | A1 | 5/2002 | Ishiguro et al. |
| 2002/0075125 | A1 | 6/2002 | Yang |

FOREIGN PATENT DOCUMENTS

| | | | |
|---|---|---|---|
| EP | 0400950 | A1 | 12/1990 |
| EP | 0400950 | B1 | 2/2000 |
| EP | 1037345 | A1 | 9/2000 |

*Primary Examiner* — Nimeshkumar Patel
*Assistant Examiner* — Donald Raleigh
(74) *Attorney, Agent, or Firm* — Cantor Colburn LLP

(57) ABSTRACT

A method of producing an electrode support for a spark plug is provided. The method includes attaching a chip to the electrode support. The chip includes a section of sacrificial material located between two sections of electrode material. The method includes substantially removing the section of sacrificial material from the chip to create a spark gap between the two sections of electrode material.

20 Claims, 2 Drawing Sheets

METHOD OF PRODUCING A SPARK GAP FOR AN ELECTRODE SUPPORT USING SACRIFICIAL MATERIAL

BACKGROUND OF THE INVENTION

The subject matter disclosed herein relates to a method of producing an electrode support for a spark plug, and more specifically to a method of producing a spark gap for an electrode support of a spark plug using sacrificial material.

Spark plugs include an electrode chip located at an end of a center electrode. A separate chip is also located on an end of a side or ground electrode. An air or spark gap is located between the chip positioned on the center electrode and the chip positioned on the ground electrode. In one approach, the spark plug is manufactured by welding a single chip to both the center electrode and the ground electrode. Then, the chip is machined to create the spark gap between the center electrode and the ground electrode. The chip is generally constructed from a precious or noble metal such as, for example, a platinum based alloy. Noble and precious metals usually have a relatively high cost.

Spark plugs for applications such as, for example, industrial engines generally require precision machining and adjustment in order to create the parallelism and clearance needed in the spark gap. Machining the air gap results in a precise and substantially parallel gap. However, machining also results in a significant amount of noble or precious metal being wasted.

BRIEF DESCRIPTION OF THE INVENTION

According to one aspect of the invention, a method of producing an electrode support for a spark plug is provided. The method includes attaching a chip to the electrode support. The chip includes a section of sacrificial material located between two sections of electrode material. The method includes substantially removing the section of sacrificial material from the chip to create a spark gap between the two sections of electrode material.

According to another aspect of the invention, a method of producing an electrode support for a spark plug is provided. The method includes providing the electrode support. The electrode support has a center portion and a side portion. The method includes providing a chip having a section of sacrificial material located between two sections of electrode material. The section of sacrificial material is brazed to the two sections of electrode material. The method includes attaching the chip to both the center portion and the side portion of the electrode support. The method includes substantially removing the section of sacrificial material from the chip to create a spark gap between the two sections of electrode material.

According to yet another aspect of the invention, a spark plug is provided. The spark plug includes an electrode support having a center portion and a side portion. The spark plug also includes at least one chip that is attached to both the center portion and the side portion. The chip includes a section of sacrificial material and two sections of electrode material. The section of sacrificial material is located between two sections of electrode material.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
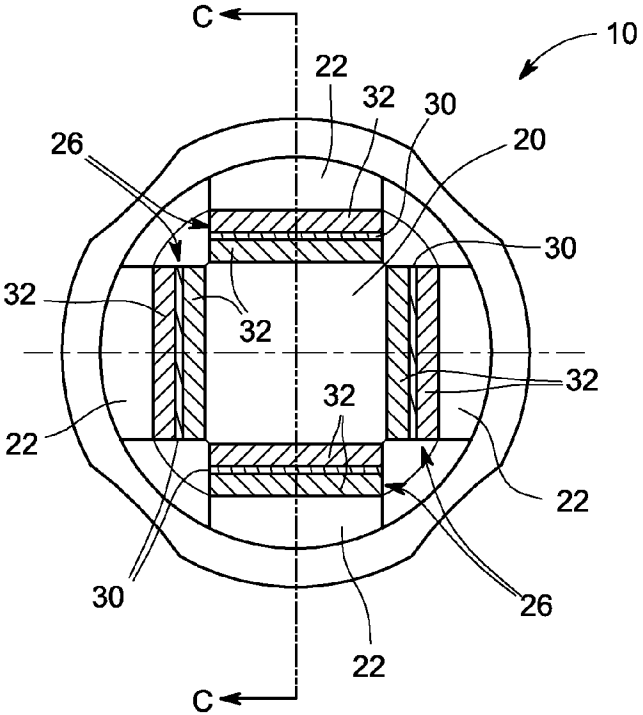
FIG. 1 is a top view of an electrode support for a spark plug having a sacrificial material.

FIG. 1 is an illustration of an exemplary electrode support 10 for a spark plug (not shown). In one exemplary embodiment, the electrode support 10 may be used in a spark plug of an industrial engine. The electrode support 10 includes a center portion 20 and a plurality of ground or side portions 22. The electrode support 10 also includes a plurality of electrode chips 26 attached to the electrode support 10. Specifically, in the embodiment as shown in FIG. 1, the electrode support 10 is part of a multi-electrode spark plug. In the embodiment as shown, the electrode support 10 includes four electrode chips 26 that are each spaced generally equidistant from one another, however, it is to be understood that any number of side portions 22 may be used as well.

Figure 4:
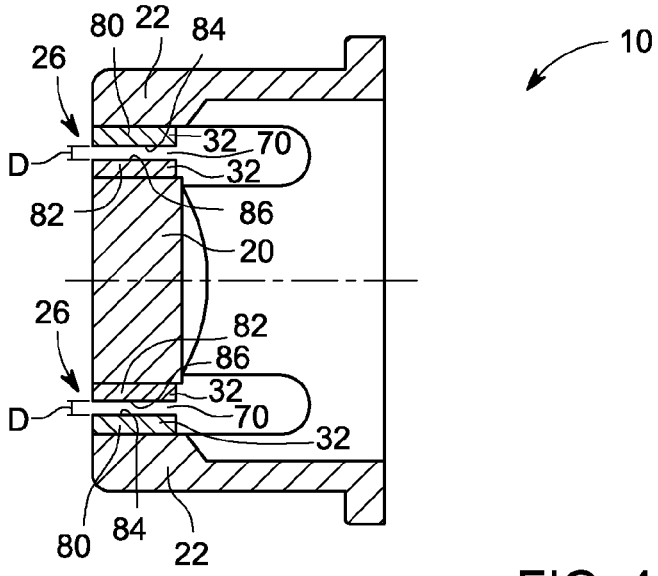
FIG. 4 is an illustration of the electrode support with a spark gap.

The electrode chip 26 includes a section of laminate or sacrificial material 30 as well as two sections of electrode material 32. The sacrificial material 30 is sandwiched or interposed between the two sections of electrode material 32. The sacrificial material 30 may be any material that is generally less costly than the sacrificial material 30. For example, the sacrificial material 30 could be a nickel alloy, a polymer, or a ceramic material. The sacrificial material 30 is eventually removed to create a spark gap 70 between the two sections of electrode material 32 (the spark gap 70 is shown in FIG. 4). The electrode material 32 may be, for example, a noble metal. In one exemplary embodiment, the electrode material 32 is a precious metal such as, for example, platinum or silver.

Figure 2:
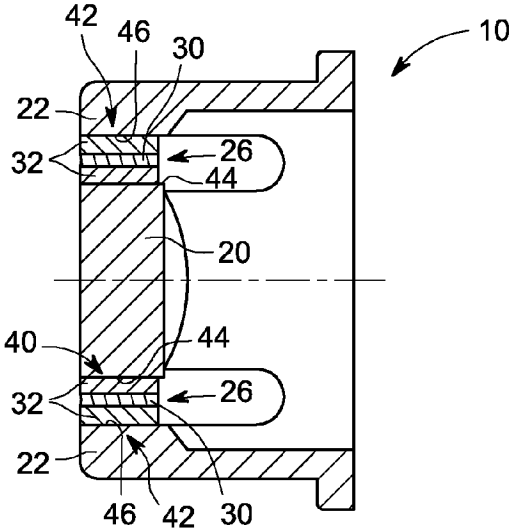
FIG. 2 is a cross-sectioned view of the electrode support shown in FIG. 1.

FIG. 2 is a cross-sectioned view of the electrode support 10 shown in FIG. 1 taken along section C-C. Referring now to both FIGS. 1-2, each of the electrode chips 26 are attached to an end portion 40 of the center portion 20. Each of the electrode chips 26 are also attached to an end portion 42 of a corresponding one of the side portions 22 of the electrode support 10. Specifically, one of the two sections of electrode material 32 is attached to an outer surface 44 of the center portion 20, and the remaining one of the two sections of the electrode material 32 is attached to an outer surface 46 of the corresponding side portion 22. The outer surface 46 of the side portion 22 is oriented to generally oppose the outer surface 44 of the center portion 20.

In one embodiment, the two sections of electrode material 32 of each electrode chip 26 are attached to either the outer surface 44 of the center portion 20 or the outer surface 46 of the corresponding side portion 22 of the electrode support 10 by a joining process such as, for example, welding or brazing. Welding involves melting and fusing both the electrode material 32 and the electrode support 10 together. Brazing generally utilizes a filler material that is used to join the electrode material 32 to the electrode support 10 together. Thus, brazing does not consume a portion of the relatively costly electrode material 32.

Figure 3:
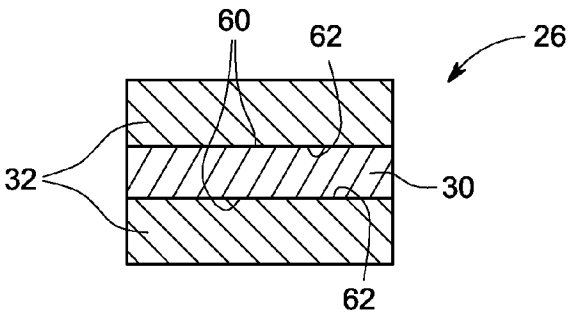
FIG. 3 is an enlarged view of an electrode chip shown in FIG. 2.

FIG. 3 is an enlarged view of one of the electrode chips 26 shown in FIGS. 1-2. In one exemplary embodiment, brazing may be used to join an outer surface 60 of the sacrificial material 30 with an outer surface 62 of each of the two sections of electrode material 32. In the event that brazing is used to join the sacrificial material 30 with the electrode material 32, the sacrificial material 30 includes a coefficient of thermal expansion that is substantially the same as the electrode material 32. Although brazing is discussed, it is to be understood that other joining approaches may be used as well.

FIG. 4 is an illustration of the electrode support 10 with the spark gap 70. Specifically, the spark gap 70 is located between a side electrode chip 80 and a center electrode chip 82. The spark gap 70 includes a distance D measured from a surface 84 of the side electrode chip 80 and a surface 86 of the center electrode chip 82. The surface 84 of the side electrode chip 80 generally opposes the surface 86 of the center electrode chip 82.

The spark gap 70 may be created by substantially removing the sacrificial material 30 (shown in FIGS. 1-3). In one example, the sacrificial material 30 is removed by a machining process. In another example, the electrode material 32 is removed by an electrochemical machining (ECM) approach, which removes metal by an electrochemical process. Although machining and electrochemical machining are discussed, it is to be understood that various other approaches may be used to remove the sacrificial material 30. The spark gap 70 is created between the two sections of electrode material 32 where the sacrificial material 30 (shown in FIGS. 1-3) used to be located.

Figure 5:
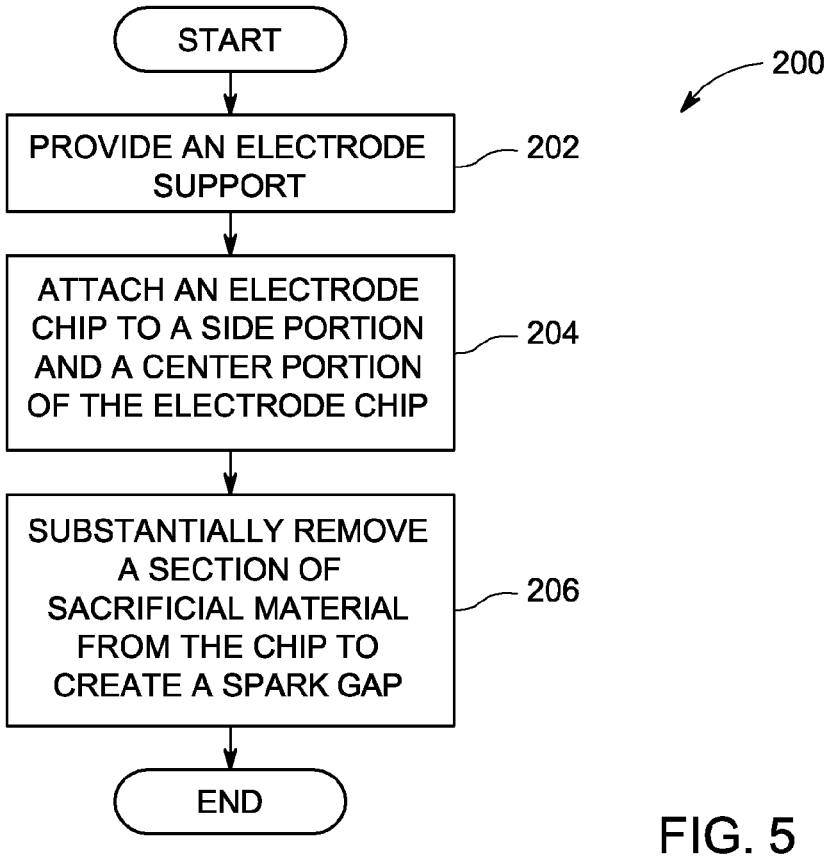
FIG. 5 is a process flow diagram of one approach to produce the electrode support shown in FIG. 4.

FIG. 5 is a process flow diagram of one approach of producing the electrode support 10 as shown in FIGS. 1-4, employing the sacrificial material 30. Referring generally to FIGS. 1-5, process 200 begins at 202, where the electrode support 10 is provided. Process 200 may then process to 204, where the electrode chip 26 is attached to the side portion 22 and the center portion 20 of the electrode support 10. In one embodiment, brazing may be used to join the electrode chip 26 to the electrode support 10. Process 200 may then proceed to 206, where the section sacrificial material 30 is substantially removed to create the spark gap 70 (shown in FIG. 4). Process 200 may then terminate.

Referring generally to FIGS. 1-5, the above-mentioned approach of removing the sacrificial material 30 to create the spark gap 70 results in reduced cost when compared to some other approaches of creating a spark gap. This is because the sacrificial material 30 is generally less expensive when compared to the material that the electrode material 30 is constructed from. In one approach, brazing may be used to join the two sections of electrode material 32 to the sacrificial material 30. Brazing does not consume a portion of the relatively costly electrode material 32, and therefore may also result in reduced cost when compared to other types of joining approaches such as, for example, welding.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of producing an electrode support for a spark plug, comprising:

attaching a chip to the electrode support, the chip including a section of sacrificial material and two sections of electrode material, the sacrificial material located between the two sections of electrode material; and substantially removing the section of sacrificial material from the chip to create a spark gap between the two sections of electrode material, wherein the sacrificial material and the electrode material are different materials.

2. The method as recited in claim 1, comprising attaching one of the two sections of electrode material to a center portion of the electrode support and a remaining of the two sections of electrode material to a side portion of the electrode support.

3. The method as recited in claim 2, comprising providing a center portion surface and a side portion surface that generally opposes the center portion surface, wherein the one of the two sections of electrode material is attached to the center portion surface and the remaining of the two sections of electrode material is attached to the side portion surface.

4. The method as recited in claim 1, comprising attaching the chip to the electrode support by at least one of brazing and welding.

5. The method as recited in claim 1, comprising substantially removing the section of sacrificial material by at least one of a machining process and an electrochemical process.

6. The method as recited in claim 1, comprising providing the section of sacrificial material that is one of a nickel alloy, a polymer, and a ceramic material.

7. The method as recited in claim 1, wherein the section of sacrificial material is brazed to the two sections of electrode material.

8. The method as recited in claim 1, wherein the section of sacrificial material includes a sacrificial coefficient of thermal expansion that is substantially the same as an electrode coefficient of thermal expansion of the two sections of electrode material.

9. The method as recited in claim 1, wherein the electrode support includes a plurality of side portions and a plurality of chips are provided, wherein one of the plurality of chips are attached to one of the plurality of side portions.

10. A method of producing an electrode support for a spark plug, comprising:

providing the electrode support, the electrode support having a center portion and a side portion;

providing a chip having a section of sacrificial material and two sections of electrode material, the sacrificial material located between the two sections of electrode material, the section of sacrificial material brazed to the two sections of electrode material;

attaching the chip to both the center portion and the side portion of the electrode support; and substantially removing the section of sacrificial material from the chip to create a spark gap between the two sections of electrode material, wherein the sacrificial material and the electrode material are different materials.

11. The method as recited in claim 10, comprising attaching one of the two sections of electrode material to the center portion and a remaining of the two sections of electrode material to the side portion.

12. The method as recited in claim 11, comprising providing a center portion surface and a side portion surface that generally opposes the center portion surface, wherein the one of the two sections of electrode material is attached to the center portion surface and the remaining of the two sections of electrode material is attached to the side portion surface.

13. The method as recited in claim 10, comprising attaching the chip to both the center portion and the side portion by at least one of brazing and welding.

14. The method as recited in claim 10, comprising substantially removing the section of sacrificial material by at least one of a machining process and an electrochemical process.

15. The method as recited in claim 10, comprising providing a nickel alloy as the section of sacrificial material.

16. A spark plug, comprising:

an electrode support having a center portion and a side portion;

at least one chip that is attached to both the center portion and the side portion, the chip including:

a section of sacrificial material; and two sections of electrode material, the section of sacrificial material located between the two sections of electrode material, wherein the sacrificial material and the electrode material are different materials.

17. The spark plug as recited in claim 16, wherein the section of sacrificial material is one of a nickel alloy, a polymer, and a ceramic material.

18. The spark plug as recited in claim 16, wherein the section of sacrificial material is brazed to the two sections of electrode material.

19. The spark plug as recited in claim 16, wherein the section of sacrificial material includes a sacrificial coefficient of thermal expansion that is substantially the same as an electrode coefficient of thermal expansion of the two sections of electrode material.

20. The spark plug as recited in claim 16, wherein the electrode support includes a plurality of side portions, wherein one of a plurality of chips are attached to one of the plurality of side portions.

* * * * *